US006755516B2

(12) United States Patent
Hanson et al.

(10) Patent No.: US 6,755,516 B2
(45) Date of Patent: Jun. 29, 2004

(54) LATCH AND HANDLE ARRANGEMENT FOR A REPLACEABLE INK CONTAINER

(75) Inventors: Lisa M. Hanson, Vancouver, WA (US); Curt G. Gonzales, Corvallis, OR (US); Dion C. Davidson, Salt Lake City, UT (US); Charles R. Steinmetz, Corvallis, OR (US); Scott D. Sturgeon, Vancouver, WA (US); David C. Johnson, Portland, OR (US); Jeffrey T. Hendricks, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/147,118

(22) Filed: May 16, 2002

(65) Prior Publication Data

US 2002/0175977 A1 Nov. 28, 2002

Related U.S. Application Data

(63) Continuation of application No. 09/556,025, filed on Apr. 20, 2000, now abandoned, which is a continuation-in-part of application No. 09/495,060, filed on Jan. 31, 2000, now Pat. No. 6,488,369.

(51) Int. Cl.[7] ..... B41J 2/175; B41J 2/14

(52) U.S. Cl. ..... 347/86; 347/87; 347/49

(58) Field of Search ..... 347/85, 86, 87, 347/49

(56) References Cited

U.S. PATENT DOCUMENTS 6,076,920 A * 6/2000 Zapata et al. ..... 347/85
6,155,678 A * 12/2000 Komplin et al. ..... 347/86

* cited by examiner

*Primary Examiner*—Anh T. N. Vo

(57) ABSTRACT

The present disclosure relates to a replaceable ink container for providing ink to an inkjet printing system. The inkjet printing system has a receiving station for receiving the replaceable ink container. The replaceable ink container includes a handle extending from a trailing end of the ink container for grasping the ink container for insertion into the receiving station. Also included is a latch for securing the replaceable ink container to the receiving station. The latch has an extended position for engaging the receiving station for securing the ink container to the receiving station and a retracted position. The latch is so disposed and arranged on the ink container to be urged from the extended position to the retracted position as the handle is grasped.

16 Claims, 11 Drawing Sheets

LATCH AND HANDLE ARRANGEMENT FOR A REPLACEABLE INK CONTAINER

CROSS REFERENCE TO RELATED APPLICATIONS

The present application is a continuation of U.S. patent application Ser. No. 09/556,025 filed Apr. 20, 2000, entitled "Latch And Handle Arrangement For A Replaceable Ink Container", now abandoned, which is a continuation-in-part of U.S. patent application Ser. No. 09/495,060 filed Jan. 31, 2000, now U.S. Pat. No. 6,488,369 entitled "Ink Container Configured To Establish Reliable Electrical And Fluidic Connections To A Receiving Station" both of which have been assigned to the same Assignee as the present application.

BACKGROUND OF THE INVENTION

The present invention relates to ink containers for providing ink to inkjet printers. More specifically, the present invention relates to ink containers that include latch and handle features for inserting and removing ink containers from a receiving station within an inkjet printer.

Inkjet printers frequently make use of an inkjet printhead mounted within a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead.

One type of previously used printing system makes use of the ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. For the case where the ink supply is separately replaceable, the ink supply is replaced when exhausted. The printhead is then replaced at the end of printhead life. Regardless of where the ink supply is located within the printing system, it is critical that the ink supply provides a reliable supply of ink to the inkjet printhead.

There is an ever present need for inkjet printing systems that make use of replaceable ink containers that are easy to install and remove. The installation and removal of the ink container should be able to be accomplished in a manner that limits customer confusion. The installation of the ink container should produce reliable fluidic connection to the printer. These ink containers should be relatively easy to manufacture, thereby tending to reduce the ink supply cost. Reduction of the ink supply cost tends to reduce the per page printing costs of the printing system. In addition, these ink containers should be compact and configured to be inserted into the inkjet printing system to maintain a relatively small overall height of the printing system allowing a low profile printing system.

SUMMARY OF THE INVENTION

One aspect of the present invention is a replaceable ink container for providing ink to an inkjet printing system. The inkjet printing system has a receiving station for receiving the replaceable ink container. The replaceable ink container includes a handle extending from a trailing end of the ink container for grasping the ink container for insertion into the receiving station. Also included is a latch for securing the replaceable ink container to the receiving station. The latch has an extended position for engaging the receiving station for securing the ink container to the receiving station and a retracted position. The latch is so disposed and arranged on the ink container to be urged from the extended position toward the retracted position as the handle is grasped.

DETAILED DESCRIPTION OF THE PREFERRED EMBODIMENT

Figure 1:
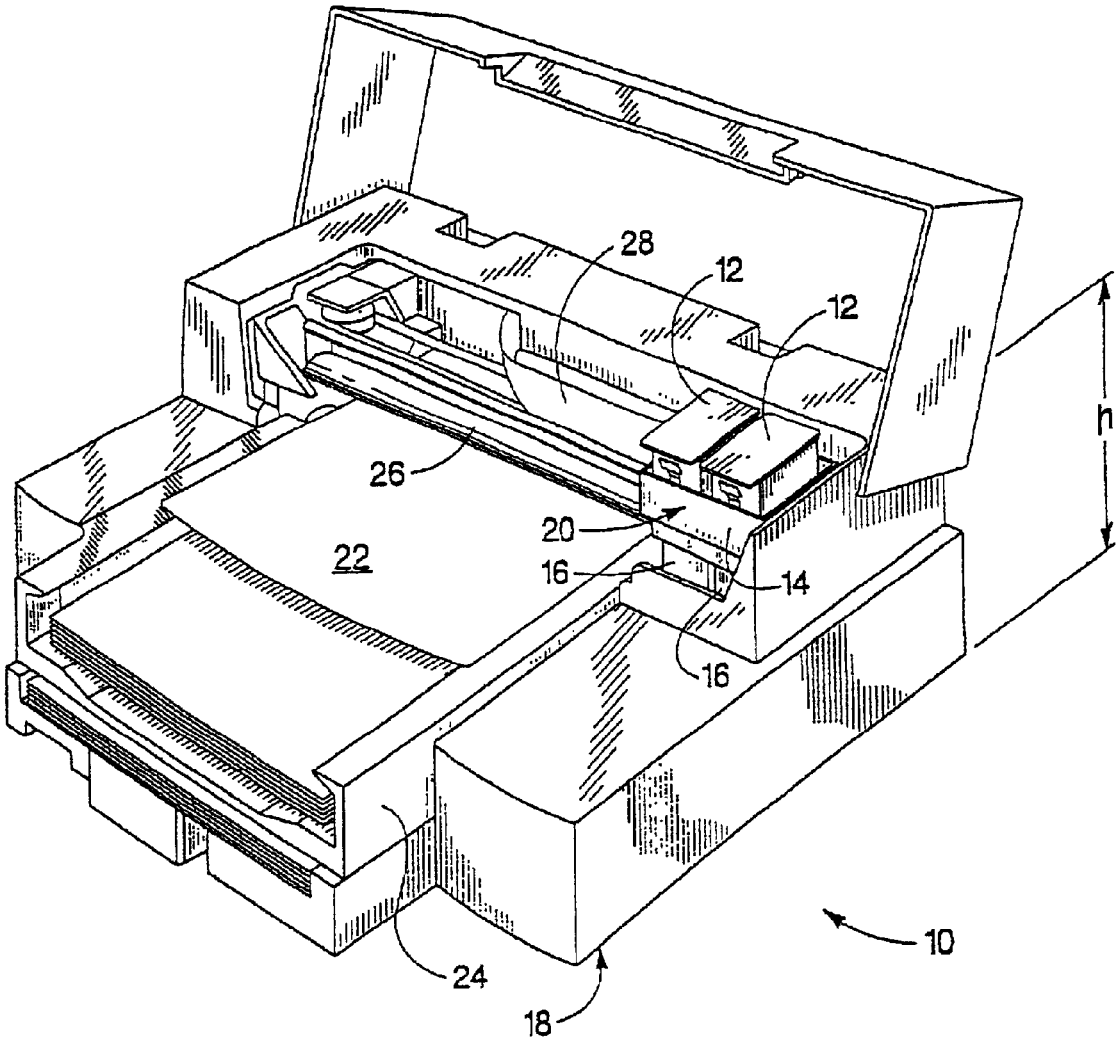
FIG. 1 is one exemplary embodiment of an inkjet printing system of the present invention shown with a cover opened to show a plurality of replaceable ink containers of the present invention.

FIG. 1 is a perspective view of one exemplary embodiment of a printing system 10 shown with its cover open, that includes at least one replaceable ink container 12 that is installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media 22. As ink is ejected from the printhead 16, the printhead 16 is replenished with ink from the ink container 12. In one preferred embodiment the replaceable ink container 12, receiving station 14, and inkjet printhead 16 are each part of a scanning carriage 20 that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

An important aspect of the present invention is the method and apparatus for inserting the ink container 12 into the receiving station 14 such that the ink container 12 forms proper fluidic and electrical interconnect with the printer portion 18. It is essential that both proper fluidic and electrical connection be established between the ink container 12 and the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 18. Information passed between the replaceable ink container 12 and the printer portion 18 includes, for example, information related to the compatibility of replaceable ink container with printer portion 18 and operation status information such as ink level information.

The method and apparatus of the present invention, as will be discussed with respect to FIGS. 2 through 11, depict those features which allow the replaceable ink container 12 to be inserted into the receiving station 14 in such a manner that reliable electrical and fluidic connection is established between the replaceable ink container 12 and the receiving station 14. In addition, the method and apparatus of the present invention allows for the insertion and removal of the replaceable printing component 12 from the printer portion 18 in a reliable fashion while allowing the overall height of the printer portion 18, represented by dimension designated as "h" in FIG. 1 to be a relatively small dimension, thereby providing a relatively low profile printing system 10. It is important that the printing system 10 have a low profile to provide a more compact printing system as well as to allow the printer portion to be used in a variety of printing applications.

Figure 2:
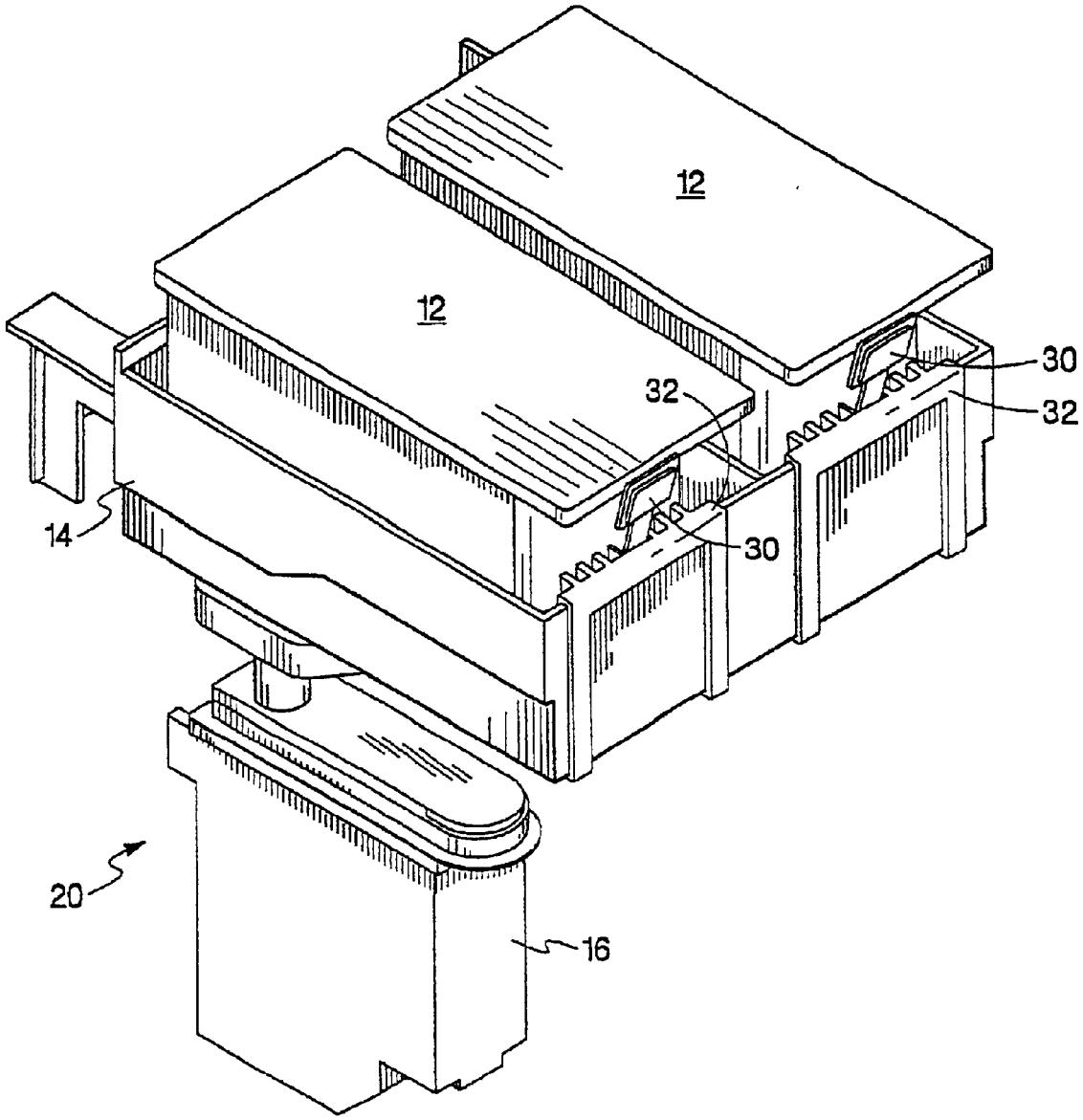
FIG. 2 is a greatly enlarged perspective view of a portion of a scanning carriage showing the replaceable ink containers of the present invention positioned in a receiving station that provides fluid communication between the replaceable ink containers and one or more printhead.

FIG. 2 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tri-color ink container containing three separate ink colors and a second ink container containing a single ink color. In this preferred embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The receiving station 14 shown in FIG. 2 is fluidically coupled to a single printhead 16 for simplicity. In the preferred embodiment, four inkjet printheads 16 are each fluidically coupled to the receiving station 14. In this preferred embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 3.

Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 3:
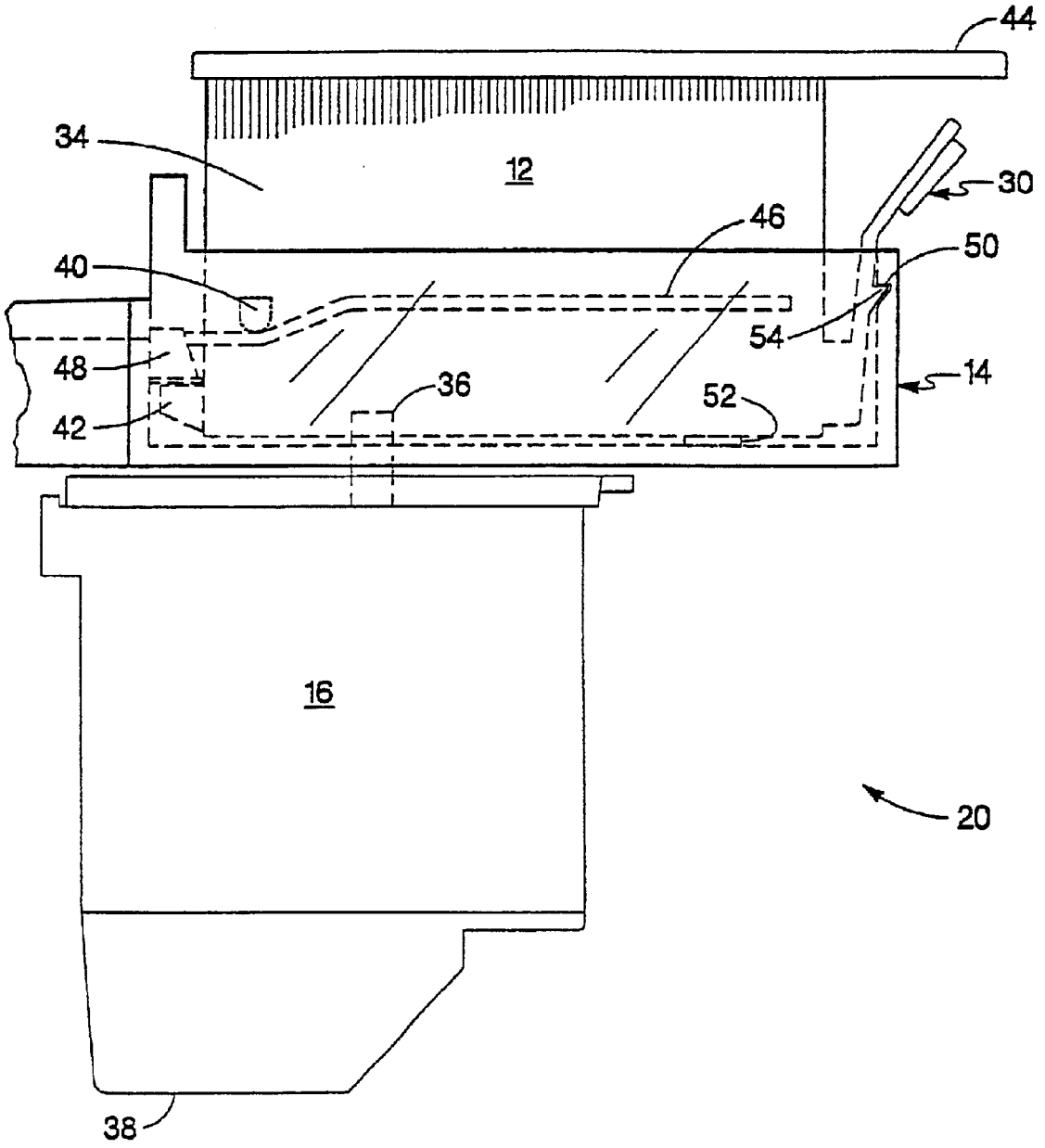
FIG. 3 is a side plan view of a portion of the scanning carriage showing guiding and latching features associated with each of the replaceable ink container and the receiving station for securing the replaceable ink container, thereby allowing fluid communication with the printhead.

FIG. 3 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in U.S. patent application entitled "Ink Reservoir for an Inkjet Printer" attorney docket 10991407 filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force, retaining within the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 3. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. As will be discussed, it is crucial that the ink container 12 be properly positioned within the receiving station 14 such that proper compression of the capillary member is accomplished when the ink container 12 is inserted into the receiving station. Proper compression of the capillary member is necessary to establish a reliable flow of ink from the ink container 12 to the printhead 16.

The replaceable ink container 12 further includes a guide feature 40, an engagement feature 42, a handle 44 and the latch feature 30 that allow the ink container 12 to be inserted into the receiving station 14 to achieve reliable fluid interconnection with the printhead 16 as well as form reliable electrical interconnection between the replaceable ink container 12 and the scanning carriage 20. The insertion and removal of the ink container 12 will be discussed with respect to FIGS. 7*a*–7*c* and 8*a*–8*b*, respectively. An important aspect of the present invention is the relative positioning of the handle 44 and the latch feature 30 that allows insertion and removal of the ink container 12 with minimal customer confusion as will be discussed with respect to FIGS. 10, 11*a* and 11*b*.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 4.

Figure 4:
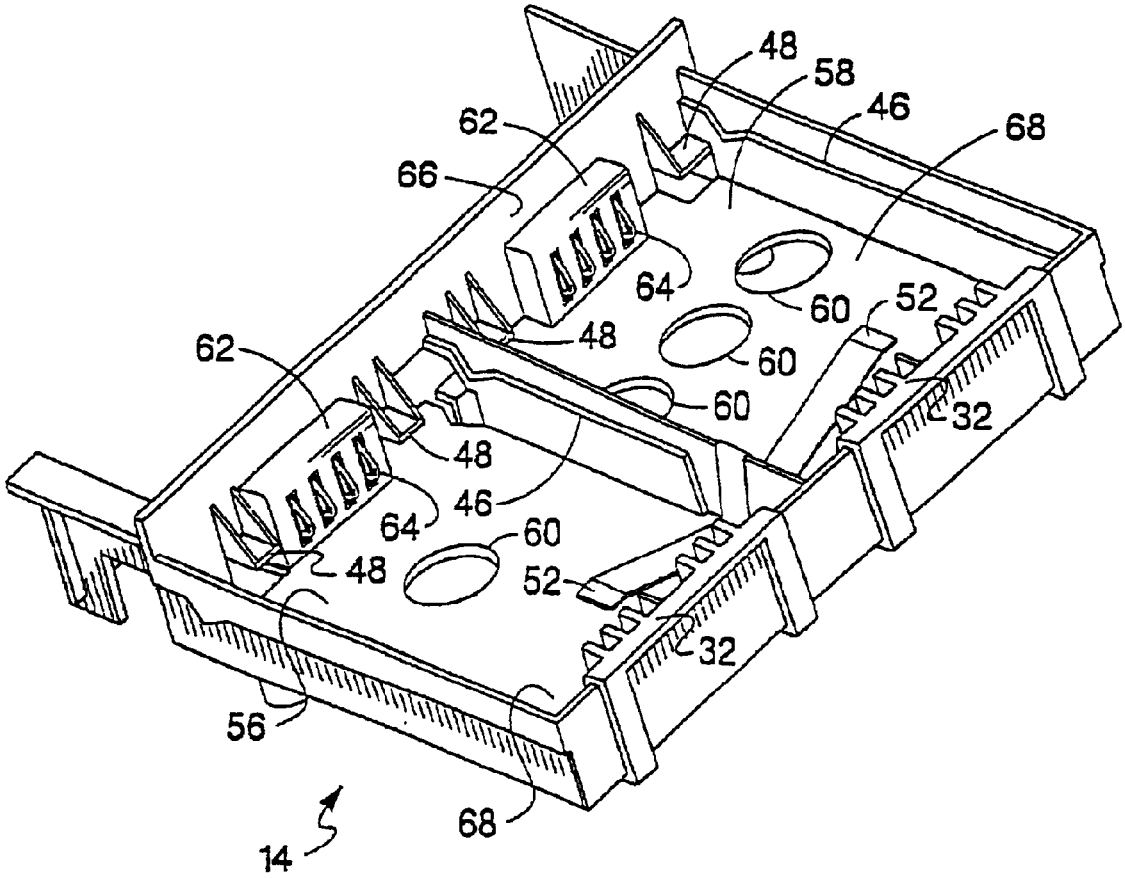
FIG. 4 is a receiving station shown in isolation for receiving one or more replaceable ink containers of the present invention.

FIG. 4 is a front perspective view of the ink receiving station 14 shown in isolation. The receiving station 14 shown in FIG. 4 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving the upright fluid interconnect 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts are an arrangement of four spring-loaded electrical contacts with proper installation of the replaceable ink container 12 into the corresponding bay of the receiving station 14. Proper engagement with each of the electrical connectors 62 and fluid interconnects 36 must be established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14. The leaf spring 52 provides a biasing force which tends to urge the ink container 12 upward from a bottom surface 68 of the receiving station 14. The leaf spring aids in the latching of the ink container 12 to the receiving station 14 as well as aiding the removal of the ink container 12 from the receiving station as will be discussed with respect to FIGS. 8 and 9.

Figure 5C:
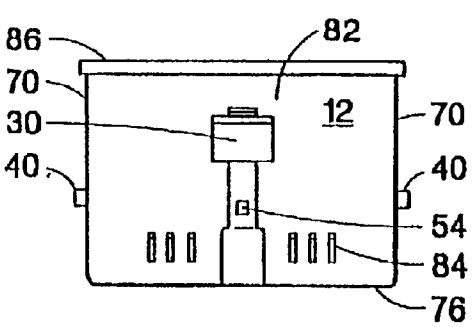
FIGS. 5*a*, 5*b*, 5*c*, and 5*d* are isometric views of a three-color replaceable ink container of the present invention shown in isolation.
Figure 5B:
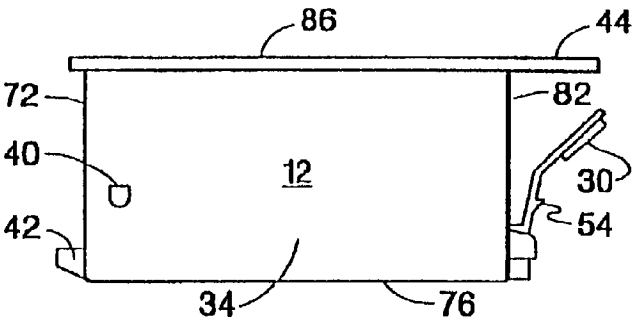
Figure 5A:
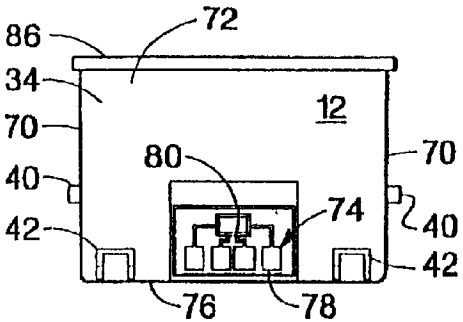
Figure 5D:
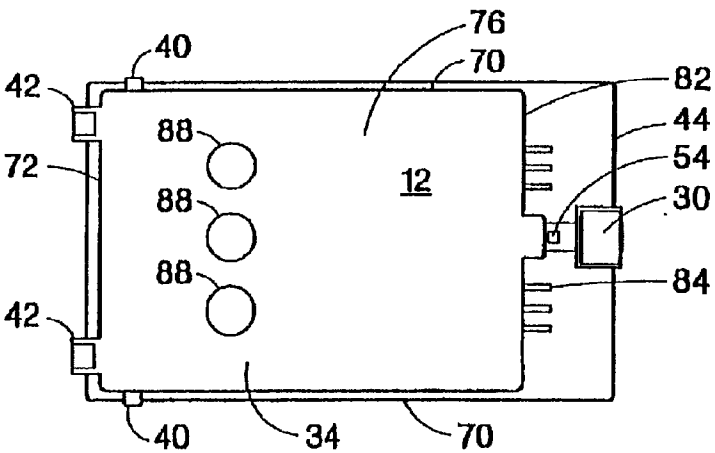

FIGS. 5*a*, 5*b*, 5*c*, and 5*d* show front plan, side plan, back plan, and bottom plan views, respectively, of the replaceable ink container 12 of the present invention. As shown in FIG. 5*a*, the replaceable ink container 12 includes a pair of outwardly projecting guide rail engagement features 40. In the preferred embodiment, each of these guide rail engagement features extend outwardly in a direction orthogonal to upright side 70 of the replaceable ink container 12. The engagement features 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Opposite the leading end 72 is a trailing end 82 shown in FIG. 5*c*. The trailing end 82 of the replaceable ink container 12 includes the latch feature 30 having an engagement hook 54. The latch feature 30 is formed of a resilient material which allows the latch feature to extend outwardly from the trailing end thereby extending the engagement feature outwardly toward the corresponding engagement feature associated with the receiving station 14. As will be discussed as the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or compatability with the corresponding receiving bay 56 and 58 within the receiving station 14.

Also included in the ink container 12 is the handle portion 44 disposed on a top surface 86 at the trailing edge 82 of the replaceable ink container 12. The handle 44 allows the ink container 12 to be grasped at the trailing edge 82 while inserted into the appropriate bay of the receiving station 14.

Finally, the ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding print head for that ink color.

Figure 6:
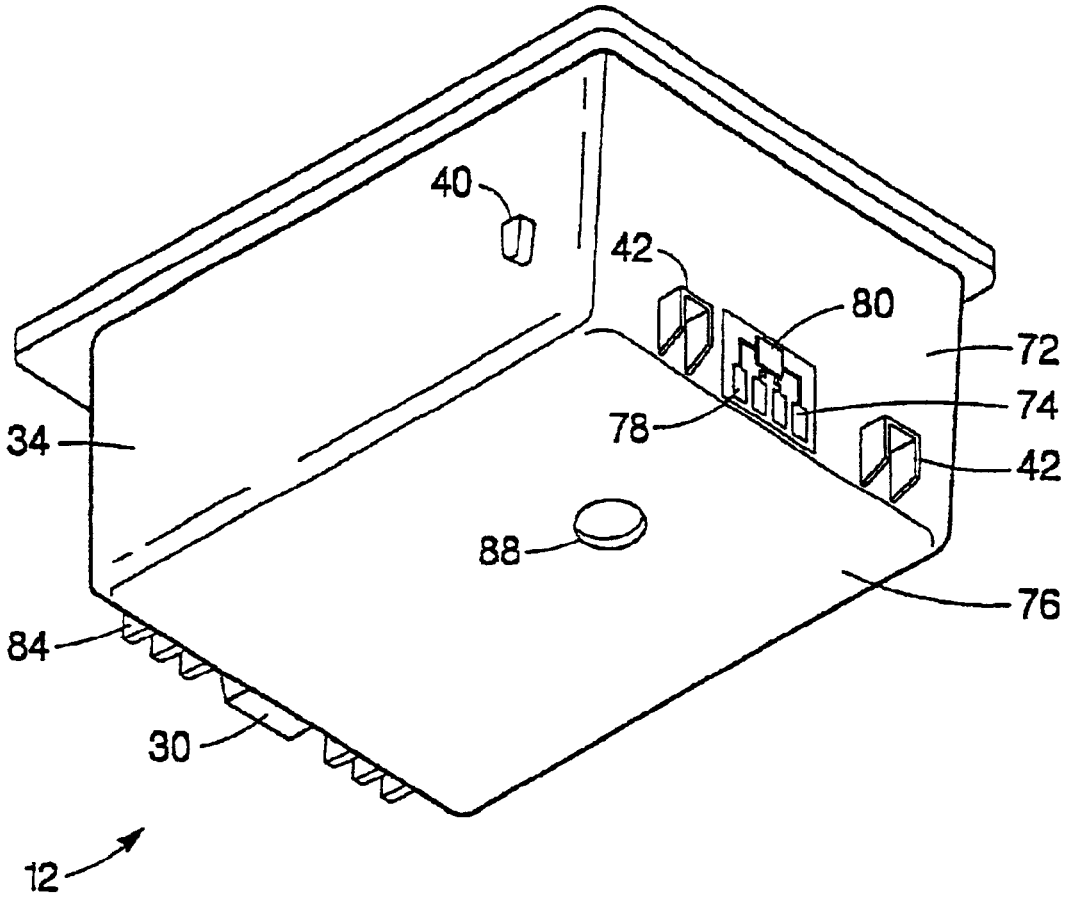
FIG. 6 is a perspective view of a single color replaceable ink container of the present invention.

FIG. 6 is a perspective view of a monochrome ink container positioned for insertion into the monochrome bay 56 in the receiving station 14 shown in FIG. 4. The monochrome ink container shown in FIG. 6 is similar to the tri-color ink container shown in FIGS. 5*a* through 5*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 7A:
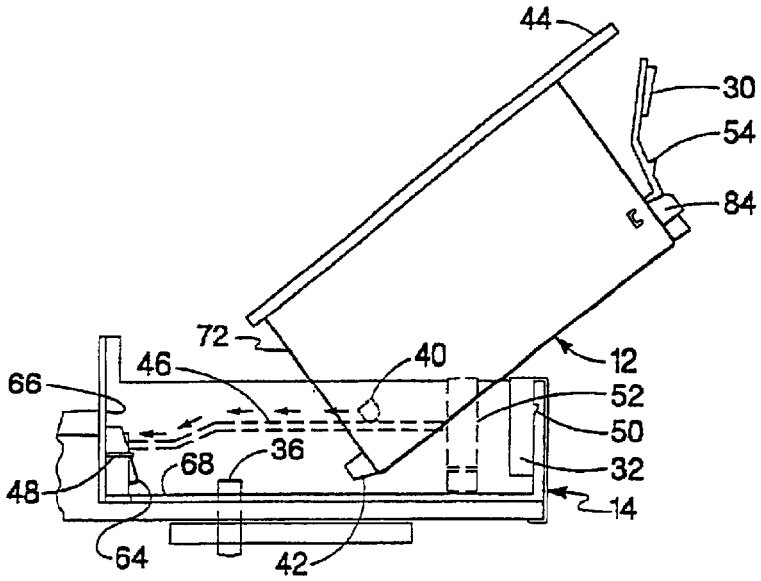
FIGS. 7*a*, 7*b*, and 7*c* depict the method of the present invention for inserting the replaceable ink container into the supply station.
Figure 7B:
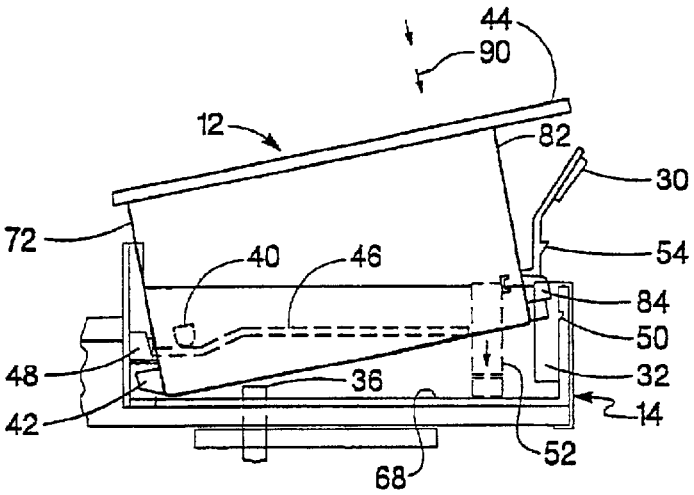
Figure 7C:
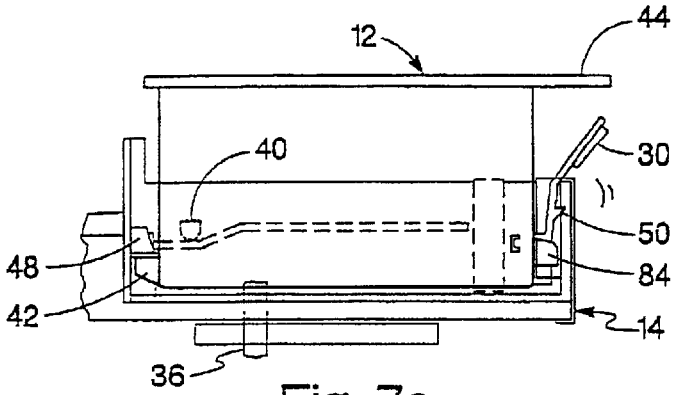

FIGS. 7*a*, 7*b*, and 7*c* is a sequence of figures to illustrate the technique of the present invention for inserting the replaceable ink container 12 into the receiving station 14 to form reliable electrical and fluidic connections with the receiving station 14.

FIG. 7*a* shows the ink container 12 partially inserted into the receiving station 14. In the preferred embodiment, the ink container 12 is inserted into the receiving station 14 by grasping the handle portion 44 and inserting the ink container into the receiving station with the leading edge or leading face 72 first. As the leading edge 72 enters the receiving station 14 the outwardly extending guide members 40 on the ink container engage each of the pair of guide rails 46. The guide rails 46 guide the ink container 12 in a horizontal or linear motion toward the back wall 66 of the receiving station 14. The guide rails 46 then guide the replaceable ink container in both a horizontal direction toward the back wall 66 and a vertical direction toward the bottom surface of the receiving station 14 such that the engagement feature 42 on the ink container 12 is received by a corresponding engagement feature 48 on the back wall 66 of the receiving station 14 as shown in FIG. 7*b*. The insertion of the ink container 12 requires only an insertion force to urge the ink container linearly along the guide rail 46. The gravitational force acting on the ink container 12 tends to cause the ink container to follow the guide rails 46 as the guide rails extend in a downward direction to allow engagement of engagement features 42 and 48. The guide rail engagement features 40 are preferably gently rounded surfaces to slide freely along the guide rails 46.

FIG. 7*b* shows the ink container 12 inserted into the receiving station 14 such that the engagement feature 42 is in engagement with the engagement feature 48 associated with the receiving station 14. A downward force is applied to the ink container 12 as represented by arrows 90 to compress the leaf spring 52 and to urge the trailing end 82 of the ink container 12 downwardly toward the bottom surface 68 of the receiving station 14. The keys 84 must properly correspond to the keying feature 32 on the receiving station 14. If the keys 84 on the ink container 12 do not correspond to the keying features 32, the keying system will prevent further insertion of the ink container 12 into the receiving station 14. This keying system made up of keys 84 and the keying features 32 prevent ink containers that are not compatible with the receiving station 14 from further insertion into the receiving station 14. Further insertion of the ink container 12 into the receiving station 14 could result in contact of the fluid interconnect 36 with the capillary member within the ink container 12, thereby contaminating the fluid interconnect 36 with incompatible ink. Incompatible ink mixing in the fluid interconnect 36 can result in precipitation which can damage the printhead 16. In addition to inks of incompatible chemistries, the ink container can have an incompatible color which can result in color mixing, thereby reducing the output print quality.

The keys 84 on the ink container 12 and the keying features 32 on the receiving station 14 allow for the complete insertion of the proper ink container 12 into the proper receiving station 14. The downward force applied to the trailing end 82 of the ink container 12 causes the ink container 12 to pivot about a pivot axis compressing the leaf spring 52, thereby moving the trailing edge 82 of the ink container 12 toward the bottom surface 68 of the receiving station 14. As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 7*c*.

With the ink container 12 properly secured in the receiving station 14 as shown in FIG. 7*c* the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. In the preferred embodiment, the ink container 12 when inserted into the receiving station 14 is oriented in a gravitational frame of reference so that a gravitational force acts on ink within the ink container 12 tending to draw ink toward the bottom surface 76 of the ink container 12. Thus ink within the ink container 12 is drawn to the bottom surface 76 where this ink is drawn toward the fluid interconnect 36 by capillary attraction thereby tending to reduce or minimize stranding of ink within the ink container 12.

Figure 8B:
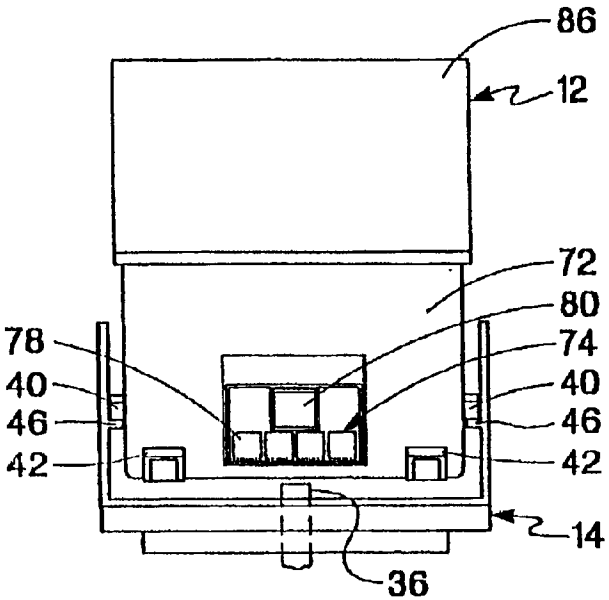
FIGS. 8*a* and 8*b* depict the passage of the replaceable ink container over an upstanding fluid inlet on the receiving station viewed from a side view and an end view, respectively.
Figure 8A:
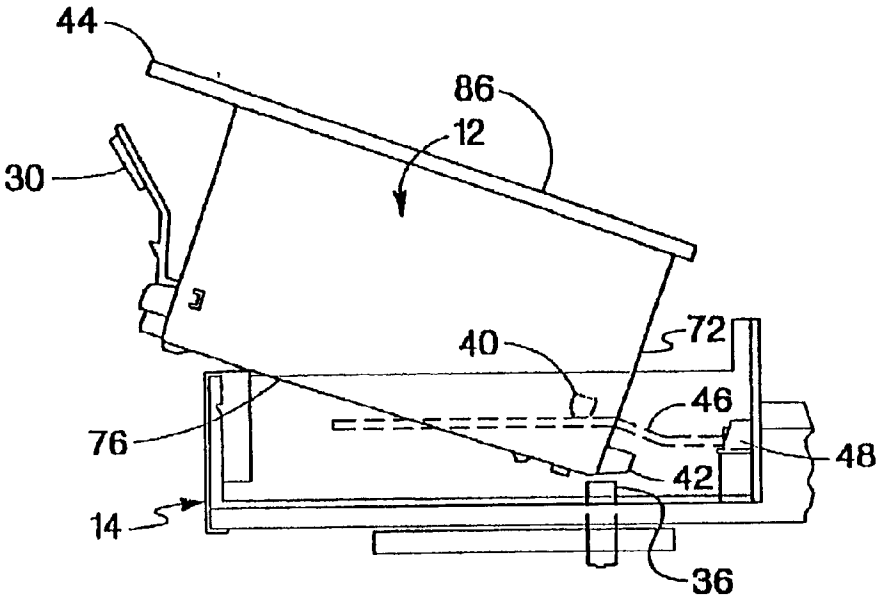

FIGS. 8*a* and 8*b* illustrate a position in the insertion process described with respect to FIGS. 7*a*, 7*b* and 7*c* wherein the leading edge 72 of the ink container 12 is positioned over the fluid interconnect 36 FIG. 8*a* depicts a side view with FIG. 8*b* showing an end view. It can be seen from FIGS. 8*a* and 8*b* that the guide feature 40 must be positioned on the ink container 12 low enough toward the bottom surface 76 of the ink container 12 such that the leading edge 72 of the ink container does not collide the fluid interconnect 36 during insertion. Another constraint on the positioning of the guide member 40 is that the guide member 40 must be positioned sufficiently close to the top surface 86 of the ink container 12 to insure that the engagement feature 42 properly engages with the corresponding engagement feature 42 on the receiving station 14.

In addition, the outwardly extending guide members 40 on the ink container must extend outward sufficiently far to engage the guide rails 46. However, the outwardly extending guide members 40 should not extend too far outward such that the guide members 40 engage the upright sides in the receiving station 14, producing interference which produces friction and binding which resists insertion of the ink container 12 into the receiving station 14.

Figure 9A:
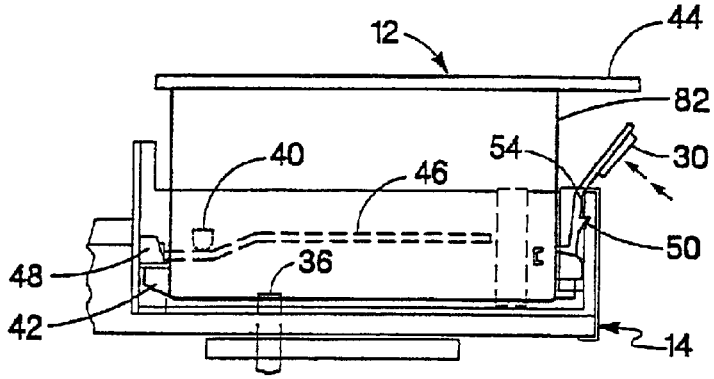
FIGS. 9*a*, 9*b*, and 9*c* depict a method of the present invention for removing the replaceable ink container from the receiving station.
Figure 9B:
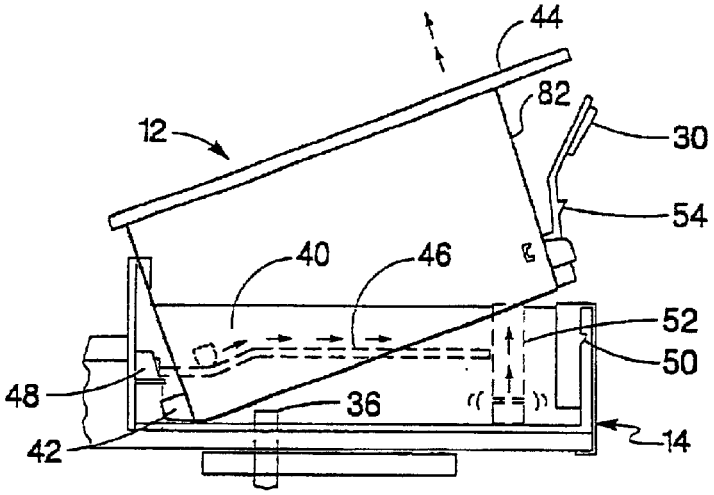
Figure 9C:
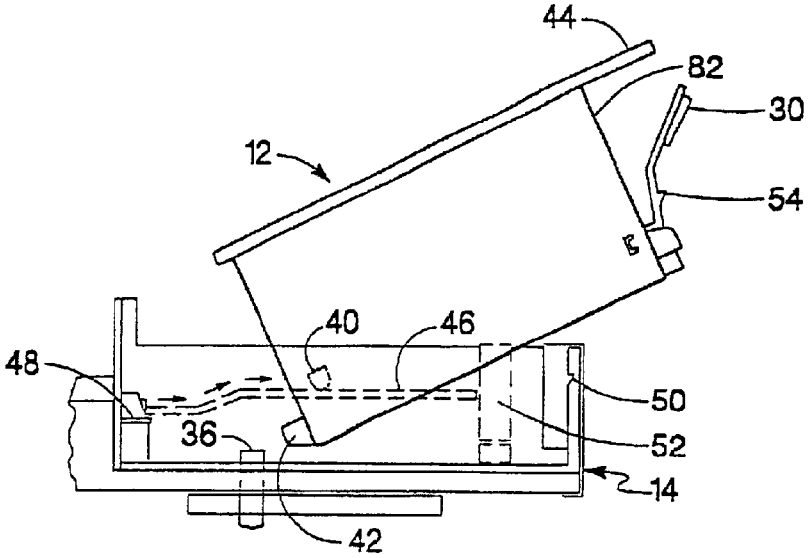

FIGS. 9*a*, 9*b*, and 9*c* illustrate the technique for removing the ink container 12 from the receiving station 14. The technique for removing the ink container 12 of the present invention begins with the release of the engagement feature from the corresponding engagement feature 50 on the receiving station 14 by urging the latch 30 toward the trailing surface 82. Movement of the latch 30 from an extended position wherein the latch 30 engages the receiving station 14 to a retracted position wherein the latch 30 does not engage the receiving station allows removal of the ink container 12 from the receiving station 14. Movement of the latch 30 is discussed in more detail with respect to FIGS. 10 and 11. Once the trailing edge of the ink container 12 is released, the spring 52 urges the trailing edge of the ink container upward as shown in FIG. 9*b*. The ink container 12 can be grasped by handle 44 to retrieve the ink container 12 in a direction opposite the insertion direction. As the ink container 12 is withdrawn from the receiving station 14, the guide member 40 follows the guide rails 46 to lift the ink container, thereby preventing interference between the fluid interconnect 36 and the fluid outlet on the bottom surface of the ink container 12.

The ink container 12 of the present invention is configured to engage and interact with the receiving station 14 to guide the ink container 12 into the receiving station and for a reliable fluid and electrical connection with the receiving station 14. The technique of the present invention allows this insertion process to be relatively simple and easy to prevent improper insertion of the ink container 12. The customer grasps the ink container 12 by the handle portion 44 and slides the ink container 12 horizontally into the receiving station 14. The guide rails 46 and guide features 40 cooperate to properly guide the ink container 12 into the receiving station 14. The ink container 12 is pressed downwardly to latch the ink container 12 and achieve operational interconnection both electrically and fluidically between the ink container 12 and the receiving station 14.

Figure 10:
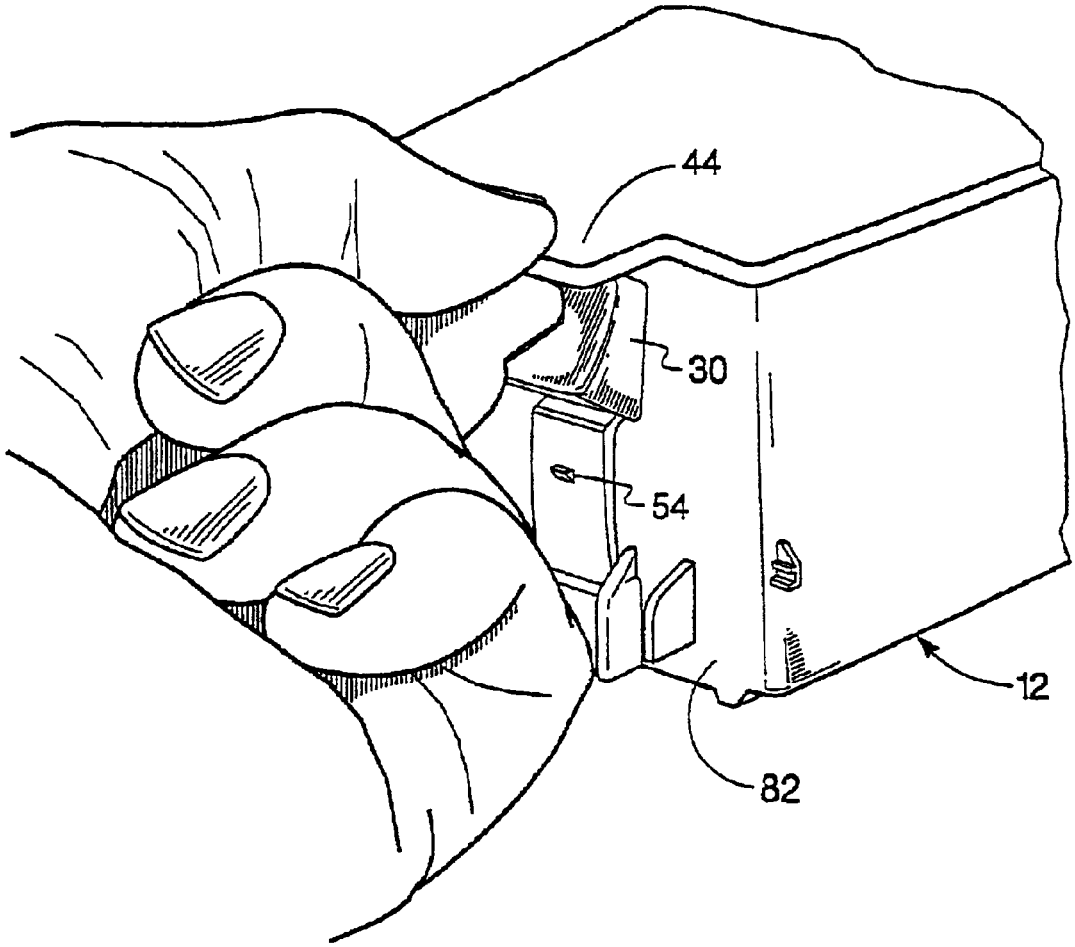
FIG. 10 is a trailing end perspective view, shown partially broken away, of one preferred embodiment of the replaceable ink container of the present invention shown grasped by a handle.

FIG. 10 shows one preferred embodiment of the ink container 12 that includes the handle 44 for grasping the ink container 12 to insert and remove the ink container 12 from the receiving station 14. In this preferred embodiment, the latch feature 30 is disposed sufficiently close to the handle 44 so as to require that the latch be urged from an extended position toward a retracted position as the handle 44 is grasped as illustrated in FIG. 10. While the ink container 12 is shown grasped between thumb and forefinger other digits as well as other positioning of digits will also result in reposition the latch 30 toward the retracted position.

The positioning of the handle 44 to extend from the trailing end 82 of the ink container 12 allows for the ink container 12 to be inserted in a linear fashion as described with respect to FIGS. 7*a*, 7*b*, and 7*c*. The insertion of the ink container 12 in a linear fashion allows the printing system 10 to have a relatively small overall height as discussed with respect to FIG. 1, thereby providing a more compact lower profile printing system. Positioning the latch 30 sufficiently close to the handle 44 such that grasping the handle 44 urges the latch 30 to the retracted position wherein the latch 30 disengages from the receiving station 14 greatly simplifies the removal of the ink container 12 from the receiving station 14 which is discussed in more detail with respect to FIGS. 9*a*, 9*b*, and 9*c*. The relative positioning of the latch 30 and handle 44 thus requires the customer to position the latch 30 in the disengaged or retracted position in order to grasp the handle 44, thereby automatically releasing the latch 30 which secures the ink container 12 to the receiving station 14. Once the latch 30 is released the customer can then remove the ink container 12 from the receiving station 14. Therefore, grasping the handle 44 and releasing the latch 30 is simplified to a single step for the customer. By simplifying the ink container removal and insertion process, customer confusion is greatly reduced or eliminated as well as printing system 10 ergonomics are improved.

Figure 11B:
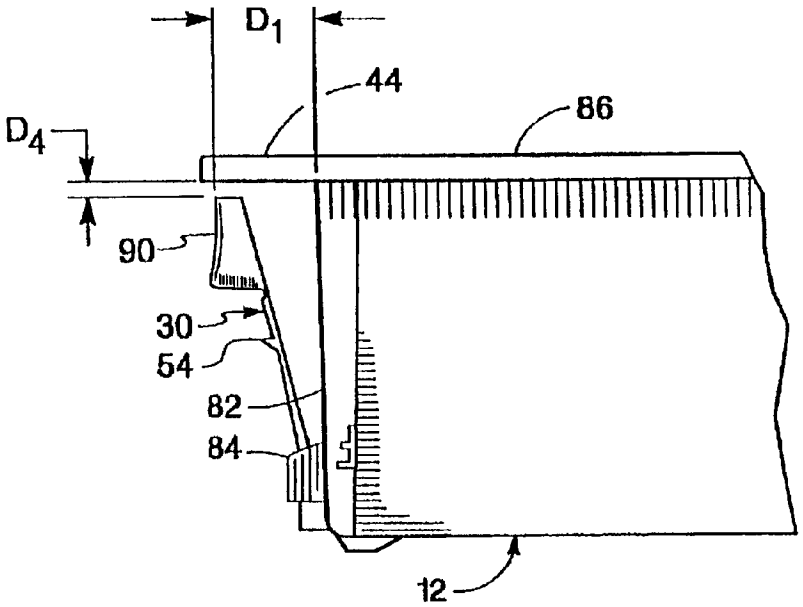
FIGS. 11*a* and 11*b* show relative positioning of the handle and a latch for the embodiment of the ink container shown in FIG. 10.
Figure 11A:
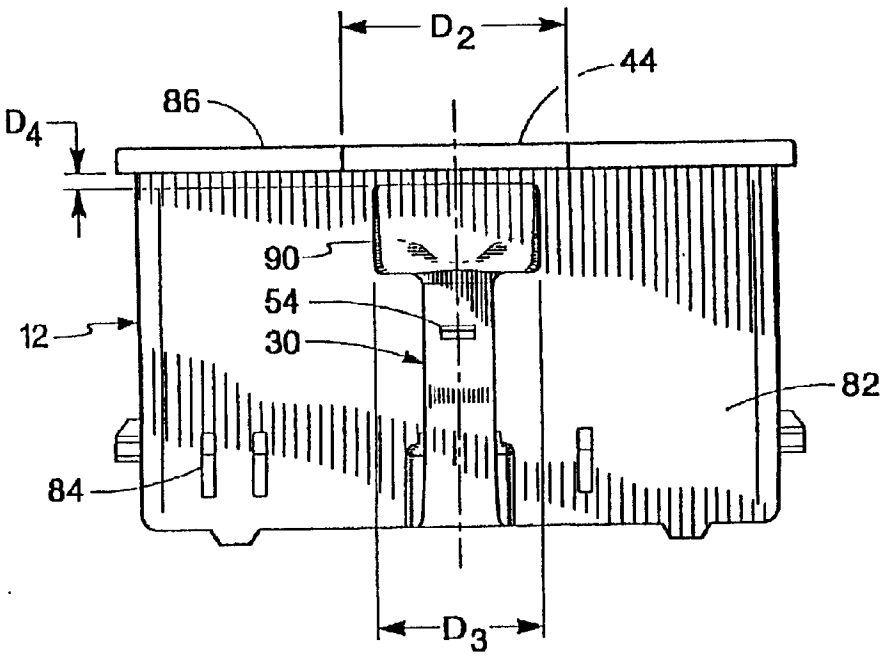

FIGS. 11*a* and 11*b* show more detail of the positioning of the handle 44 and latch 30 to reduce customer confusion and to simplify installation and removal of the ink container 12 from the receiving station 14. In this preferred embodiment, the handle 44 is sized to be to be of a minimum size in which most customers can grasp the handle 44. The handle 44 in the preferred embodiment is an extension of the top surface 86 or lid of the ink container 12. In this preferred embodiment, the handle 44 extends from the trailing end 82 of the ink container 12 a distance D1 as shown in FIG. 11*b*. The distance D1 in this preferred embodiment is determined from anthropometric data to allow 95 percent of the population both male and female, to be able to grasp this handle portion. The handle portion 44 has a width dimension represented by dimension D2 as shown in FIG. 11*a* which is also selected from anthropometric data to allow at least 95 percent of all customers to be able to grasp the handle portion 44.

The latch 30 in the preferred embodiment is centrally aligned with the handle portion 44 so that grasping the handle 44 engages the latch 30. In this preferred embodiment, the latch 30 has a widened end portion 90 at an end opposite an end attached to the ink container 12. In this preferred embodiment, the widened end portion 90 has a width represented by D3 that is selected to prevent a portion of the population having small digits from being able to grasp the handle 44 at an edge without engaging the latch 30 (the minimum grasping width). In this manner, the widened end 90 of the latch 30 accounts for variation in digit size across the population. In the preferred embodiment, the end portion 90 of the latch 30 has a concave shape that allows the digit which engages the end portion 90 to slide across its surface as the latch moves from the engagement position to the nonengagement position.

In the preferred embodiment, as shown in FIG. 11*b*, the handle 44 extends from the trailing edge 82 a distance that is greater than a distance the end portion 90 of latch 30 extends. By extending the handle 44 a distance beyond where the end portion 90 of the latch 30 extends tends to prevent inadvertent damage to the latch 30 when the ink container 12 is dropped. In addition, the handle 44 also acts to cover or protect the latch 30 to prevent customers from removing the latch 30. Before extending the handle 44 over the latch 30, testing indicated that a certain percentage of the population had a tendency to try to remove the latch 30 in a manner similar to a pull tab on a soft drink can.

In the preferred embodiment, the end portion 90 of the handle 30 is positioned a vertical distance from the handle 44, represented by D4 in FIG. 11*b*, that is small enough to prevent fingers from getting pinched between the latch 30 and the handle 44. The vertical distance between the handle 44 and the end point 90 of latch 30 as represented by D4 should be small enough to prevent a digit to fit between the handle 44 and the latch 30 thereby allowing a customer to grasp the handle without depressing or moving the latch 30 to the release position.

What is claimed is:

1. A replaceable ink container for providing ink to an inkjet printing system, the inkjet printing system having a receiving station for receiving the replaceable ink container, the replaceable ink container comprising:

a handle extending from a trailing end of the ink container for grasping the ink container for one of insertion and removal from the receiving station; and a latch for securing the replaceable ink container to the receiving station, the latch having an extended position for engaging the receiving station for securing the ink container to the receiving station and a retracted position, wherein the latch is so disposed and arranged on the ink container so as to be immediately adjacent to and directly beneath the handle so that the latch is required to be urged from the extended position toward the retracted position as the handle is grasped.

2. The replaceable ink container of claim 1 wherein the handle has a handle width and the latch has a latch width and wherein a difference between the handle width and the latch width is less than a minimum grasping width.

3. The replaceable ink container of claim 1 wherein the latch is centrally aligned with the handle.

4. The replaceable ink container of claim 1 wherein the handle is centrally aligned with the ink container.

5. The replaceable ink container of claim 4 wherein the latch is centrally aligned with the handle.

6. The replaceable ink container of claim 1 wherein a distance the handle extends from the trailing end of the ink container is greater than a distance the latch extends from the ink container in the extended position.

7. The replaceable ink container of claim 1 wherein the latch is positioned from the handle a distance small enough to prevent a digit from fitting between the handle and the latch.

8. A replaceable ink container configured for insertion into a receiving station of an inkjet printing system, the replaceable ink container comprising:

a handle for grasping the ink container for one of insertion and removal from the receiving station; and a latch for securing the replaceable ink container to the receiving station, the latch having a latched position and an unlatched position, wherein the latch is positioned closely proximate and directly under the handle so as to require positioning of the latch in the unlatched position as the handle is grasped.

9. The replaceable ink container of claim 8 wherein the handle has a handle width and the latch has a latch width arid wherein the latch width is approximately equal to the handle width.

10. The replaceable ink container of claim 8 wherein the latch is disposed from the handle a distance small enough to prevent a digit from fitting between the handle and the latch.

11. A method for inserting a replaceable ink container into an inkjet printing system comprising:

providing an ink container having a latch portion and a handle portion which is immediately adjacent to and directly above the latch portion;

grasping the handle portion thereby automatically urging a latch portion from an extended position to a retracted position; and inserting the replaceable ink container into the inkjet printing system.

12. The method of claim 11 wherein inserting the replaceable ink container into the inkjet printing system further includes:

engaging a pair of outwardly extending guide rail engagement features on the ink container with each of a pair of guide rails on a receiving station; and urging the ink container toward the receiving station wherein each of the pair of guide rails guide the replaceable ink container linearly toward a backwall of the receiving station then downward toward a bottom surface of the receiving station to align a fluid outlet on the replaceable ink container with a fluid inlet proximate the bottom surface of the receiving station.

13. A method for removing a replaceable ink container from a receiving station of an inkjet printing system, the method for removing the replaceable ink container comprising:

providing an ink container having a latch portion and a handle portion which is immediately adjacent to and directly above the latch portion;

grasping the handle portion thereby automatically urging a latch portion from an extended position to a retracted position; and removing the replaceable ink container from the receiving station of the inkjet printing system.

14. The method of claim 13 wherein removing the replaceable ink container into the inkjet printing system includes:

allowing a latch end of the ink container to be urged upward from a bottom surface of the receiving station by a biasing device; and sliding the replaceable ink container away from a backwall of the receiving station, the replaceable ink container being guided by a pair of outwardly extending guide rail engagement features on the ink container that are in engagement with each of a pair of guide rails on the receiving station.

15. A replaceable ink container for providing ink to an inkjet printing system, the inkjet printing system having a receiving Station for receiving the replaceable ink container, the replaceable ink container comprising:

a handle for one of insertion and removal of the ink container into and out of the receiving station; and a latch having an engagement position for securing the replaceable ink container to the receiving station and a non-engagement position, the latch so disposed and arranged so as to be immediately adjacent to and directly beneath the handle so that the latch is required to be urged toward the non-engagement position as the handle is grasped.

16. The replaceable ink container of claim 15 wherein the latch is moved to the non-engagement position as the handle is released.

* * * * *